US010006162B2

(12) United States Patent
Schaben

(10) Patent No.: US 10,006,162 B2
(45) Date of Patent: Jun. 26, 2018

(54) HYBRID HEAT DRYER

(76) Inventor: Kurt T. Schaben, St. Elizabeth, MO (US)

( * ) Notice: Subject to any disclaimer, the term of this patent is extended or adjusted under 35 U.S.C. 154(b) by 1053 days.

(21) Appl. No.: 13/017,789

(22) Filed: Jan. 31, 2011

(65) Prior Publication Data

US 2012/0000088 A1 Jan. 5, 2012

Related U.S. Application Data

(60) Provisional application No. 61/361,300, filed on Jul. 2, 2010.

(51) Int. Cl.
*D06F 58/28* (2006.01)
*D06F 58/26* (2006.01)

(52) U.S. Cl.
CPC ..... *D06F 58/26* (2013.01); *D06F 58/28* (2013.01); *D06F 2058/289* (2013.01); *D06F 2058/2829* (2013.01); *D06F 2058/2883* (2013.01); *D06F 2058/2893* (2013.01)

(58) Field of Classification Search
CPC ..... D06F 58/28; D06F 2058/28; D06F 2058/2829; D06F 2058/289; D06F 2058/2893; D06F 2058/2883
USPC ..... 34/427, 84, 549, 86
See application file for complete search history.

(56) References Cited

U.S. PATENT DOCUMENTS

| | | | | |
|---|---|---|---|---|
| 2,958,140 | A * | 11/1960 | Smith | 34/598 |
| 3,116,123 | A * | 12/1963 | Sasnett | 34/527 |
| 4,546,554 | A * | 10/1985 | Bullock et al. | 34/554 |
| 6,237,855 | B1 * | 5/2001 | Stickney et al. | 237/8 R |
| 6,941,680 | B1 | 9/2005 | Zielewicz et al. | |
| 7,658,015 | B1 * | 2/2010 | Gardell | 34/90 |
| 2006/0218812 | A1 * | 10/2006 | Brown | 34/86 |

FOREIGN PATENT DOCUMENTS

| | | | |
|---|---|---|---|
| KR | 2006065484 A | * | 6/2006 |
| KR | 2006065484 | | 12/2006 |

OTHER PUBLICATIONS

Kansas State University Engineering Extension: Solid-Fuel Heating Appliances, Jun. 2003, pp. 6-7 http://www.engext.ksu.edu/ees/henergy/space/SolidFuelHeating.pdf.*

* cited by examiner

*Primary Examiner* — Jessica Yuen
(74) *Attorney, Agent, or Firm* — Don V. Kelly; Evans & Dixon, L.L.C.

(57) ABSTRACT

A clothes dryer may rely on a hybrid heat source for drying clothes. In some embodiments, the clothes dryer may rely on a combination of electrical energy to power the clothes dryer and hydronic heat to dry clothes. The hydronic heat may, for example, use hot water from an outdoor wood boiler circulated into a hydronic coil. Air passing over the hydronic coil may be warmed and delivered to the clothes dryer. The hybrid heat clothes dryer may reduce energy consumption from about 27 amperes to about 3 amperes.

19 Claims, 2 Drawing Sheets

HYBRID HEAT DRYER

CROSS-REFERENCE TO RELATED APPLICATIONS

This application claims the benefit of priority to U.S. Provisional patent application No. 61/361,300, filed Jul. 2, 2010, the contents of which are herein incorporated by reference.

BACKGROUND OF THE INVENTION

The present invention relates to clothes dryers and, more particularly, to a hybrid heat clothes dryer.

Conventional resistive electric heat clothes dryers require a significant electric power supply, often up to about 30 amperes. Environmentally conscious consumers and/or those consumers seeking to reduce their electric consumption, often look for alternative means for clothes drying. Some alternative methods, such as air drying, may result in stiff clothes. Air drying also does not permit the use of dryer sheets, which may be useful to soften and freshen clothing.

As can be seen, there is a need for a clothes dryer that may be able to use an alternate heat source for clothes drying.

SUMMARY OF THE INVENTION

In one aspect of the present invention, a hybrid heat clothes dryer comprises a hydronic coil adapted to receive a liquid, the liquid capable of being warmed by an exterior heat source; a blower adapted to pass air over the hydronic coil and into the clothes dryer; and a control circuit adapted to switch a resistive heat element on and off.

In another aspect of the present invention, a method for drying clothes, comprises placing the clothes into a dryer drum of a dryer; providing a flow of air into the dryer drum; warming the flow of air by passing the flow of air over a hydronic coil, the hydronic coil having warmed liquid flowing therethrough; detecting a temperature of the flow of air passing into the dryer drum; and activating a resistive heating element if the temperature is below a predetermined minimum.

These and other features, aspects and advantages of the present invention will become better understood with reference to the following drawings, description and claims.

DETAILED DESCRIPTION OF THE INVENTION

Figure 1:
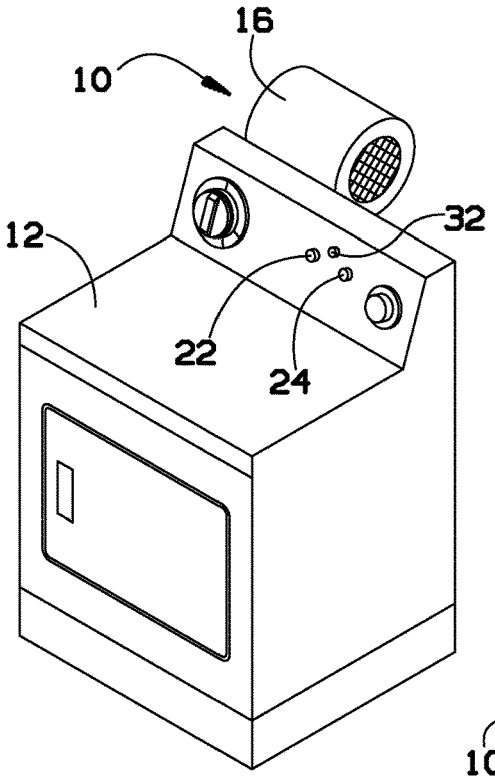
FIG. 1 is a front perspective view of a hybrid heat clothes dryer according to an exemplary embodiment of the present invention.
Figure 2:
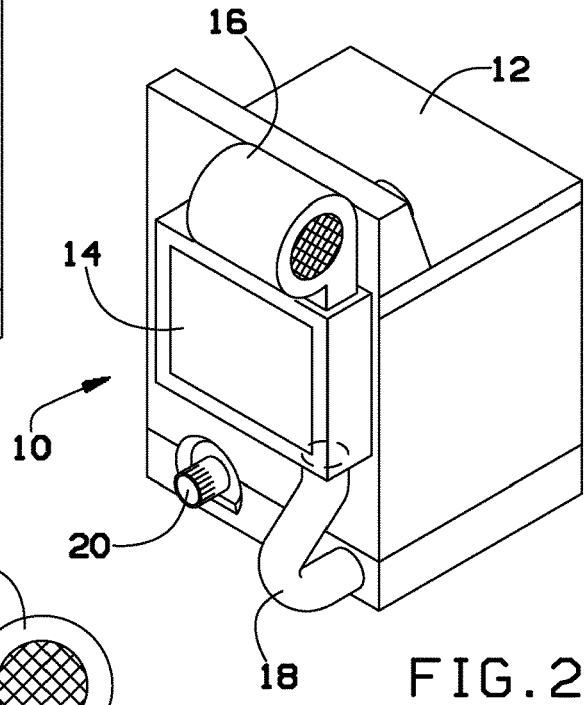
FIG. 2 is a rear perspective view of the hybrid heat clothes dryer of FIG. 1.
Figure 3:
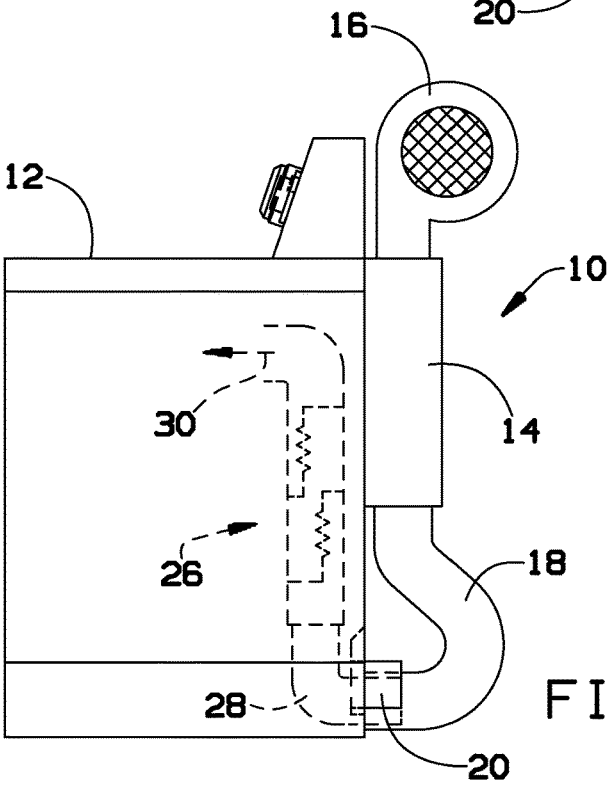
FIG. 3 is a side view of the hybrid heat clothes dryer of FIG. 1.
Figure 4:
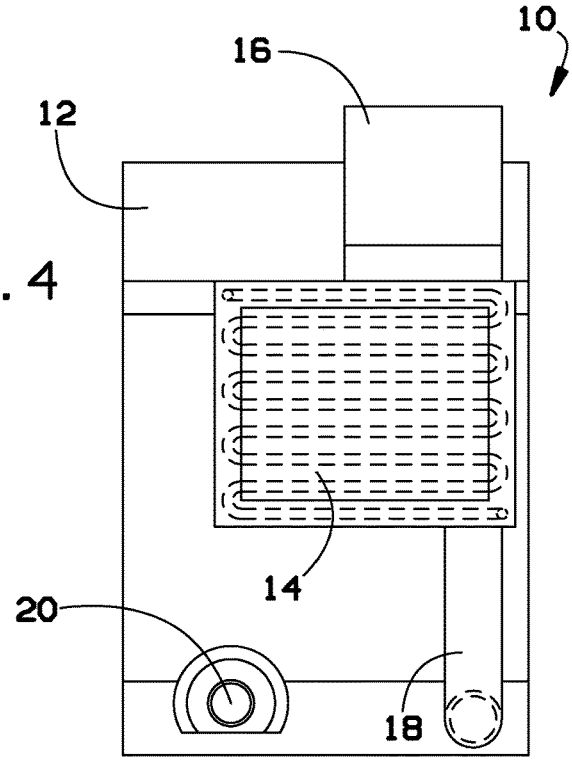
FIG. 4 is a back view of the hybrid heat clothes dryer of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a clothes dryer that may rely on a hybrid heat source for drying clothes. In some embodiments, the clothes dryer may rely on a combination of electrical energy to power the clothes dryer and hydronic heat to dry clothes. The hydronic heat may, for example, use hot water from an outdoor wood boiler circulated into a hydronic coil. Air passing over the hydronic coil may be warmed and delivered to the clothes dryer. The hybrid heat clothes dryer may reduce energy consumption from about 27 amperes to about 3 amperes.

Referring now to FIGS. 1 through 4, a hydronic heat clothes dryer 10 may include a clothes drying unit 12 and a hybrid heat driver 14. The hybrid heat driver 14 may be configured as an air-liquid heat exchanger, where a liquid may pass through tubing (a hydronic coil, for example) within the hybrid heat driver 14. Air passing over the tubing may be warmed as it passes through the hybrid heat driver 14. The liquid in the tubing may be, for example, water. The liquid may be warmed in, for example, an outdoor wood boiler. In other embodiments, the liquid may be warmed by a gas fired furnace, an oil fired furnace, a hot water storage tank or the like.

A blower 16 may deliver air across the hybrid heat driver 14 and into the dryer unit 12 via a heat supply duct 18. The air entering the dryer unit 12 may pass through factory elements 26 before being released into a dryer drum 30. The factory elements 26 may provide supplemental heat to the air entering the dryer drum 30 as may be necessary, for example, when high heat is called for or when the source of heat for the hybrid heat driver 14 is shut down. Warmed air entering the dryer drum 30 may be discharged through an exhaust vent 20.

The dryer unit 12 may include a plurality of indicator lamps. For example, the dryer unit 12 may include an "electric heat" indicator lamp 22 and a "hybrid heat" indicator lamp 24. A master switch 32 may be disposed on the dryer unit 12 for turning the hybrid system on and off.

Figure 5:
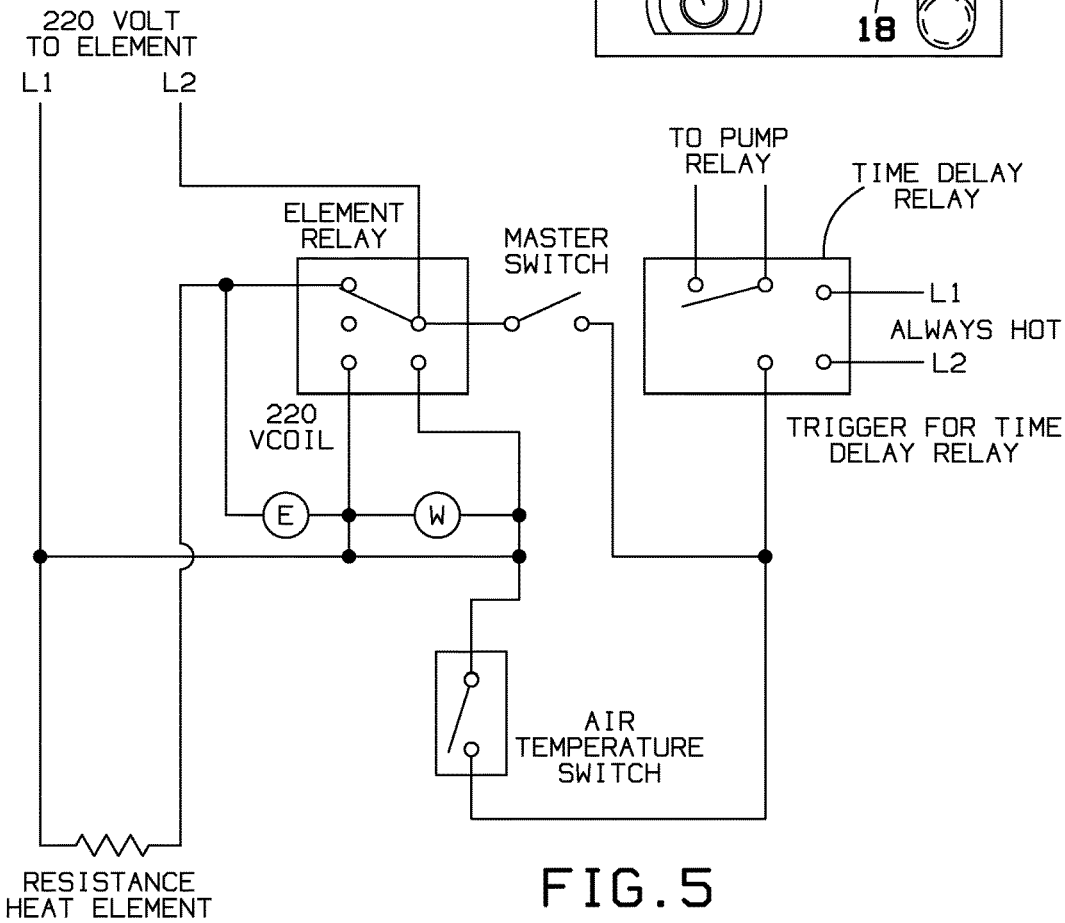
FIG. 5 is a schematic view of an electrical circuit useful to power the hybrid heat clothes dryer of FIG. 1.

Referring to FIG. 5, a schematic drawing describing the electric control of the hybrid heat dryer 10 is shown. While FIG. 5 describes one specific electric control scheme, other schemes may be used to control the hybrid heat dryer 10. When the call for heat begins, the resistive heat element, supply air blower and electric heat illumination lamp 22 are active. Voltage to the resistive heat element may be used to power the pump relay, which may be used to activate the hydronic pump located on, for example, an outdoor wood stove (not shown). When the air temperature sensor (which may be located between the hydronic coil and the original inlet of the dryer) senses the correct temperature of air, the element relay may open the circuit to the resistive heat element and the hybrid heat indicator lamp 24 may illuminate. At this point, the dryer is using hydronic heat to dry the clothes. If the air temperature falls below a predetermined minimum, the element relay may close to activate the resistive heat element.

In some embodiments of the present invention, a time delay relay may be employed. In a typical dryer cycle, the clothes dryer calls for heat from the start of the cycle until a cool-down point is reached. At the cool-down point, the dryer may no longer call for heat and shut down the source of heat, running on air to cool the clothes in the dryer. The time delay may be used to allow the hydronic pump to continue to run during at least a portion of a cool down cycle of the dryer (the cool down cycle being from the cool-down point to the end of the overall dryer cycle (dryer shut off)). The time delay may allow the use of hydronic heat for a predefined period of time into the cool down cycle. For example, from about 20 to about 80% of the time of the cool down cycle may include hydronic heat. For example, for a 10 minute cool down cycle, from 2 to 8 minutes, typically from about 5-7 minutes, of the cool down cycle may be run with continued hydronic heat being supplied.

The hybrid heat dryer 10 may be made through the addition of the hydronic heat driver 14 (hydronic coil), a supplemental blower, and a control circuit to a conventional dryer. In other embodiments, the hybrid heat dryer 10 may be a self-contained unit with connections to supply the dryer with recirculated warmed liquid from an exterior heat source (with the hydronic coil and blower installed within the dryer housing).

It should be understood, of course, that the foregoing relates to exemplary embodiments of the invention and that modifications may be made without departing from the spirit and scope of the invention as set forth in the following claims.

What is claimed is:

1. A hybrid heat clothes dryer comprising:
- a dryer drum and heat supply duct;
- a hydronic coil and a resistive heat element housed within the heat supply duct, the hydronic coil adapted to receive a liquid from an exterior heat source;
- the hydronic coil and resistive heat element configured to exchange heat with air passing through the heat supply duct;
- a blower adapted to pass air over the hydronic coil and the resistive heat element and into the dryer drum; and
- a control circuit adapted to switch the resistive heat element on and off in response to a predetermined temperature of air entering the dryer drum.

2. The hybrid heat clothes dryer of claim 1, wherein the exterior heat source is selected from one of an oil furnace or a gas furnace.

3. The hybrid heat clothes dryer of claim 2, further comprising a temperature sensor for detecting a temperature of air passing into the dryer, wherein the temperature sensor provides a signal to the control circuit and the control circuit is adapted to turn the resistive heat element on and off based on the signal.

4. The hybrid heat clothes dryer of claim 3, further comprising a time delay relay adapted to control a hydronic pump into a cool down cycle of the dryer, wherein the hydronic pump is adapted to cycle the liquid through the hydronic coil and the exterior heat source.

5. The hybrid heat clothes dryer of claim 2, further comprising:
- an indicator lamp indicating when the resistive heat element is off; and
- an indicator lamp indicating when the resistive heat element is on.

6. The hybrid heat clothes dryer of claim 5, further comprising a time delay relay adapted to control a hydronic pump into a cool down cycle of the dryer, wherein the hydronic pump is adapted to cycle the liquid through the hydronic coil and the exterior heat source.

7. The hybrid heat clothes dryer of claim 1, wherein the exterior heat source is a wood boiler adapted to warm the liquid passing through the hydronic coil.

8. The hybrid heat clothes dryer of claim 7, further comprising a temperature sensor for detecting a temperature of air passing into the dryer, wherein the temperature sensor provides a signal to the control circuit and the control circuit is adapted to turn the resistive heat element on and off based on the signal.

9. The hybrid heat clothes dryer of claim 8, further comprising a time delay relay adapted to control a hydronic pump into a cool down cycle of the dryer, wherein the hydronic pump is adapted to cycle the liquid through the hydronic coil and the exterior heat source.

10. The hybrid heat clothes dryer of claim 7, further comprising:
- an indicator lamp indicating when the resistive heat element is off; and
- an indicator lamp indicating when the resistive heat element is on.

11. The hybrid heat clothes dryer of claim 10, further comprising a time delay relay adapted to control a hydronic pump into a cool down cycle of the dryer, wherein the hydronic pump is adapted to cycle the liquid through the hydronic coil and the exterior heat source.

12. The hybrid heat clothes dryer of claim 1, further comprising a temperature sensor for detecting a temperature of air passing into the dryer, wherein the temperature sensor provides a signal to the control circuit and the control circuit is adapted to turn the resistive heat element on and off based on the signal.

13. The hybrid heat clothes dryer of claim 1, further comprising:
- an indicator lamp indicating when the resistive heat element is off; and
- an indicator lamp indicating when the resistive heat element is on.

14. The hybrid heat clothes dryer of claim 1, further comprising a master switch for powering the clothes dryer.

15. The hybrid heat clothes dryer of claim 1, wherein the liquid is water.

16. The hybrid heat clothes dryer of claim 1, further comprising a time delay relay adapted to control a hydronic pump into a cool down cycle of the dryer, wherein the hydronic pump is adapted to cycle the liquid through the hydronic coil and the exterior heat source.

17. A method for drying clothes, comprising:
- providing a dryer with a dryer drum and a heat supply duct containing a hydronic coil and resistive heat element; the hydronic coil and resistive heat element configured to exchange heat with air passing through the heat supply duct;
- placing clothes into the dryer drum of a dryer;
- providing a flow of air through the heat supply duct and into the dryer drum;
- warming the flow of air by passing the flow of air over the hydronic coil, the hydronic coil having liquid warmed by an exterior heat source flowing therethrough;
- detecting a temperature of the flow of air passing into the dryer drum; and
- activating the resistive heating element if the temperature is below a predetermined minimum.

18. The method of claim 17, further comprising:
- indicating a hybrid heat mode by illuminating an indicator on the dryer, the hybrid heat mode being when the resistive heating element is not activated; and
- indicating an electric heat mode by illuminating an indicator on the dryer, the electric heat mode being when the resistive heating element is activated.

19. A method for drying clothes, the method comprising:

providing the hybrid heat clothes dryer of any of claims 1-11;

placing clothes into the dryer drum of the dryer;

providing a flow of air into the dryer drum;

warming the flow of air by passing the flow of air over the hydronic coil, the hydronic coil having liquid warmed by an exterior heat source flowing therethrough;

detecting a temperature of the flow of air passing into the dryer drum;

activating the resistive heating element if the temperature is below a predetermined minimum;

indicating a hybrid heat mode by illuminating a hybrid heat lamp on the dryer, the hybrid heat mode being when the resistive heating element is not activated; and indicating an electric heat mode by illuminating an electric heat lamp on the dryer, the electric heat mode being when the resistive heating element is activated.

* * * * *